United States Patent [19]

Lund

[11] 3,955,613

[45] May 11, 1976

[54] FOUNDRY MOLD CONVEYOR SYSTEM

[75] Inventor: Robert S. Lund, Elmhurst, Ill.

[73] Assignee: Pettibone Corporation, Chicago, Ill.

[22] Filed: Feb. 3, 1975

[21] Appl. No.: 546,266

[52] U.S. Cl. ..... 164/130; 164/324; 198/85

[51] Int. Cl.[2] ..... B22D 5/04

[58] Field of Search ..... 164/130, 324; 198/85

[56] References Cited

UNITED STATES PATENTS

| | | | |
|---|---|---|---|
| 2,792,603 | 5/1957 | Anderson | 164/324 |
| 2,863,398 | 12/1958 | Granath | 164/324 X |
| 3,083,421 | 4/1963 | Taccone | 164/324 X |
| 3,576,246 | 4/1971 | Hulet et al. | 164/324 X |
| 3,612,159 | 10/1971 | Golesky | 164/324 |
| 3,743,004 | 7/1973 | Becke | 164/130 X |

FOREIGN PATENTS OR APPLICATIONS

| | | | |
|---|---|---|---|
| 715,283 | 9/1954 | United Kingdom | 198/85 |

*Primary Examiner*—Ronald J. Shore
*Attorney, Agent, or Firm*—Norman H. Gerlach

[57] ABSTRACT

A foundry mold conveyor system for the intermittent movement or indexing of pallets or other mold carriers successively first past a mold receiving station where a foundry sand mold is placed on each empty pallet, then to and through a jacket transfer station where a conventional jacket is placed on each palletized mold, then past a pouring station where each palletized and jacketed mold is poured with molten metal, then back to and through the jacket transfer station where the jacket is lifted from each poured palletized and jacketed mold, then past a mold discharge station where the poured mold is pushed from each pallet, and finally back through the mold receiving station where a fresh sand mold is again placed on each empty pallet. Pallet movements are effected in longitudinal and transverse paths and jacket placing and withdrawal operations are conducted at a single intersection (jacket transfer station) between a longitudinal path and a transverse path by simple up and down vertical motions of a jacket lifter at such intersection. Also, the use of a double length index on one path permits, despite the intersection, an endless system without paths passing over or under one another.

19 Claims, 7 Drawing Figures

EMPTY PALLET
PALLET WITH MOLD
MOLD WITH JACKET
POURED MOLD WITH JACKET
POURED MOLD-JACKET OFF
CYLINDERS
MAKE MOLD
DISCHARGE MOLD
JACKET TRANSFER
UP
DOWN

V9
JTS
12
14
16
18
20
22
24
26
28
29

FOUNDRY MOLD CONVEYOR SYSTEM

The present invention relates generally to conveyor systems and has particular reference to an intermittent or step-by-step conveyor system which is designed primarily for handling sand molds in a foundry casting operation of the like and wherein the unpoured molds are conducted on individual pallets through various mold-handling and treating stations to a mold discharge station where the poured and partially cooled and solidified mold-encased castings are ejected from the system for shake-out purposes.

A mold-handling system of the general character under consideration usually requires jacket-setting because in making a casting, when molten metal is poured into a sand mold to produce the casting, the outward pressure on the mold walls may cause mold rupture so that what is commonly referred to as a "run-out" of the metal takes place. It is therefore at the present time common practice in connection with many mold-handling systems to surround each mold with an encompassing metal jacket which will withstand such outward pressure on the mold walls, the jacket being placed upon the cold mold prior to the pouring operation and such pouring operation taking place with the jacket in position on or around the mold. Subsequently and after a predetermined cooling period has elapsed so that undue outward pressure on the mold walls is alleviated, the jacket is removed and the mold-encased casting is then ready for the usual shake-out operation for effecting removal of the mold from the formed casting.

It has long been the practice in connection with a foundry mold-handling system of this character to convey the molds on rectangular pallets which move intermittently in a closed loop-like path so that the empty pallets are conducted successively past a mold-receiving station where an assembly sand mold is deposited on each pallet, and then travel in order past a jacket-applying station, a pouring station, a jacket-removal station, and a mold discharge or push-out station, after which each empty pallet is returned to the mold-receiving station for reception thereon of a fresh mold, the operation of the system being continuous or repetitious while the system is in use.

One particular type of foundry mold-handling system is predicated upon the rectilinear movement of the pallets in linearly straight longitudinal and transverse paths, utilizing horizontally and longitudinally extending cylinder and piston units for intermittently advancing the pallets one unit length at a time along longitudinal paths and utilizing similar transversely extending cylinder and piston units for shifting the pallets one at a time from one longitudinal path to the next adjacent longitudinal path at the end of each longitudinal run. Thus, a generally serpentine, yet rectilinear, overall path of movement is defined for the various mold-carrying pallets. More specifically, after the empty pallets have been moved one at a time and intermittently past the mold-receiving station where they receive fresh molds thereon, each thus palletized mold then moves in a first longitudinal path forwardly past the jacket-applying station and thereafter through the pouring station, after which the poured palletized and jacketed mold is caused to shift transversely to a next adjacent and second longitudinal path which is parallel to the first longitudinal path, thus effecting a reverse movement where it is conducted rearwardly during a cooling phase back to the vicinity of the jacket-applying station. The jacket-removal station is disposed in this second longitudinal path alongside the jacket-applying station in the first path and, by the use of a jacket-transfer mechanism which is common to both stations, and consequently to both longitudinal paths, the jacket on the hot poured mold in the second longitudinal path is gripped and lifted from such mold to a position above the latter and is then shifted laterally until it overlies the cold unpoured mold in the first longitudinal path, after which it is lowered onto the unpoured cold palletized mold in the first longitudinal path and then released. After the hot palletized mold in the second longitudinal path has been relieved of its jacket, another transverse pallet shift is effected and the poured and palletized mold, now devoid of its jacket, is again impelled further, still in its cooling phase, to a point where adequate cooling has taken place to justify the shake-out operation. At this time, another path shift is effected and this carries the partially cooled poured and palletized mold to a discharge station where the mold-enclosed casting is pushed from the pallet. Thereafter, the empty pallet is again conducted rearwadly and returned to the molding station for reception thereon of a fresh foundry sand mold.

The use of such a serpentine type mold-handling system as described above is possessed of certain limitations, principal among which is the necessity for utilizing a relatively complicated jacket transfer mechanism which is capable of transferring a jacket from a hot poured and palletized mold in the second longitudinal path of pallet movement to a cold unpoured and palletized mold in the first longitudinal path of pallet movement. Since the two molds between which the jacket transfer is to be effected are laterally displaced from each other and occupy positions in different laterally spaced apart longitudinal paths of pallet movements, it is necessary for the jacket transfer mechanism to employ a superstructure which bridges or overlies both paths and embodies overhead gripping facilities. Such jacket transfer operations are carried out by first vertically aligning the gripping facilities of the system with the hot jacketed and poured mold in the second path and then lowering such gripping facilities and causing them to engage the jacket on such mold, after which raising of the facilities will cause the gripped jacket to be picket up from the hot mold and raised until the jacket clears the subjacent mold. Thereafter, such gripping facilities with the jacket held thereby are shifted laterally so as to become aligned with the cold unjacketed mold in the first longitudinal path, after which lowering thereof will place the jacket on the cold mold, whereupon release of the gripping facilities will leave the jacket operatively positioned on the cold mold. The thus released gripping facilities are again elevated into the confines of the superstructure and indexing of the conveyor system is resumed, thus shifting the hot mold, now relieved of its jacket, longitudinally and rearwardly out of the jacket removal station and shifting the cold mold with the newly applied jacket thereon longitudinally and forwardly out of the jacket-applying station. Time is lost during performance of the actual jacket transfer operations which includes such steps as opening and closing the jaws of the gripper facilities, as well as shifting such facilities from one path to the other and back again.

The present invention is directed to the elimination of the complicated motions and mechanisms needed to grip, lift, transfer, lower, release, and return which are characteristic of jacket shifting from a mold in one line to a mold in an adjacent line. This invention using longitudinal and transverse paths which also index alternately, establishes an intersection of a longitudinal and a transverse path such that following a transverse index the intersection will be occupied by a poured mold with jacket and following a longitudinal index the intersection will be occupied by an unpoured mold requiring a jacket (see FIG. 1*b* of the drawings). As a result the jacket shifting device need only be a simple up and down mechanism, removing a jacket from a poured mold by an upward movement after a transverse index, and setting a jacket on an unpoured mold by a downward movement after a longitudinal index.

From FIG. 1*b* it is obvious that with such an intersection an endless or continuous flow of pallets requires that one path cross another, with the obvious solution that one path be elevated over another. While obvious, this solution is undesirable because transferring pallets uphill or downhill introduces other problems of control. A novel solution provided by the present invention is the utilization of a transverse path which transfers the pallet not from one longitudinal path to the next adjacent, but rather to the second adjacent longitudinal path. Thus the invention permits the longitudinal and transverse paths to "cross" without passing over or under one another.

The provision of a foundry mold conveyor system such as has briefly been outlined above, and possessing the stated advantages, constitutes the principal object of the present invention.

Numerous other objects and advantages, not at this time enumerated, will readily suggest themselves as the nature of the invention is better understood.

The invention consists in the several novel features which are hereinafter set forth and are more particularly defined by the claims at the conclusion hereof.

In the accompanying three sheets of drawings forming a part of this specification, one illustrative embodiment of the invention is shown.

In these drawings:

FIG. 1 is a plan view, schematic in its representation, of a cyclicly-operable foundry mold pallet conveyor system embodying the principles of the present invention;

FIG. 1*a* is a legended descriptive chart of certain symbolic, pallet, mold and jacket representations which are used in connection with FIG. 1;

FIG. 1*b* is a flow chart illustrating the closed path of movement of the various mold-supporting pallets which are associated with the pallet conveyor system;

Figures 1, 1A, 1B, 3:
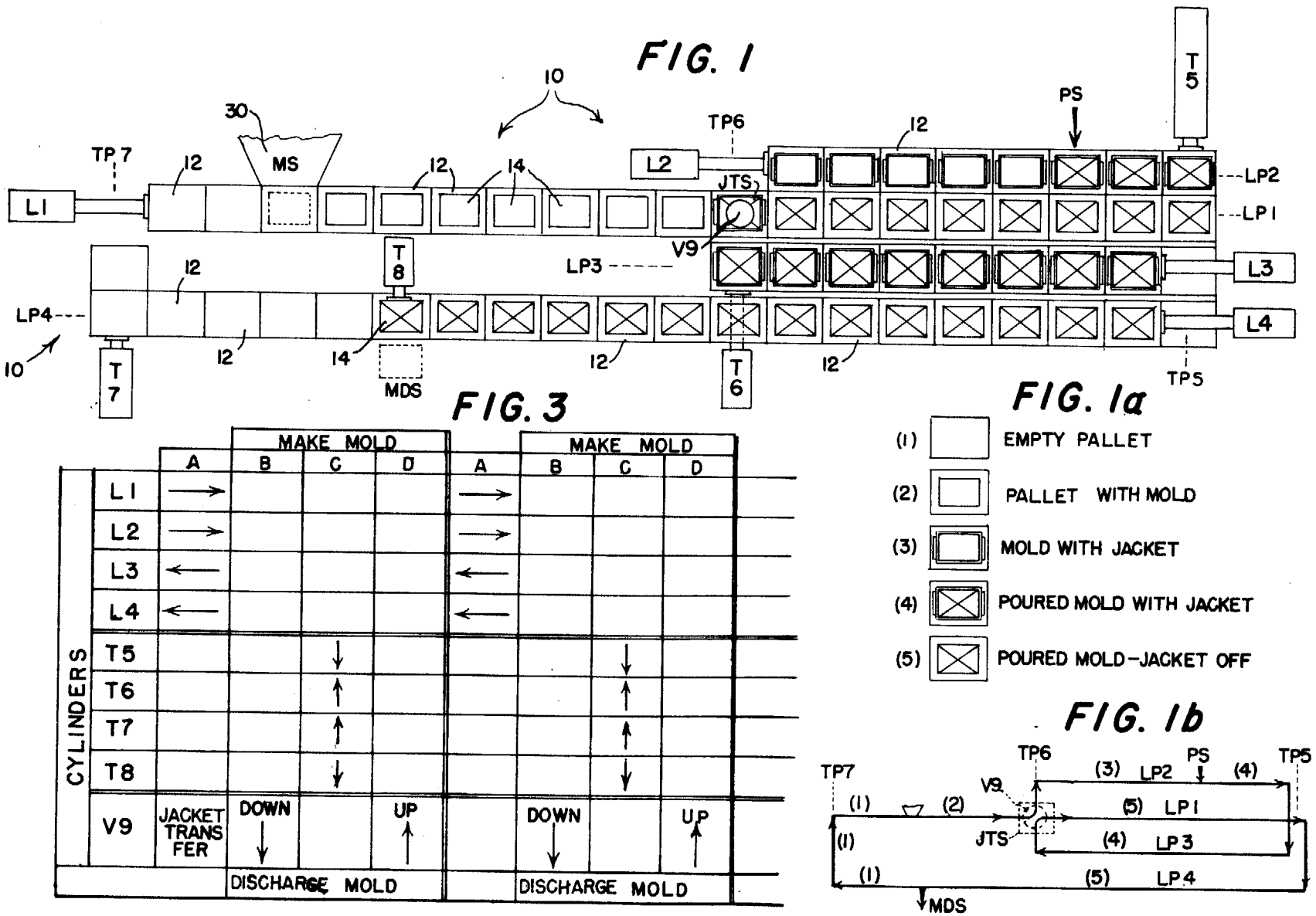
FIG. 3 is a sequence chart illustrating the cyclic operation of the conveyor system.

Referring now to the drawings in detail and in particular to FIGS. 1, 1*a* and 1*b*, the schematic representation of FIG. 1 is intended to represent a foundry mold conveyor system 10 wherein a plurality of rectangular pallets 12 are caused to move successively in a closed compound quadrangular loop as shown in FIG. 1*b* so that each pallet is carried from a mold-receiving station MS where a freshly formed sand mold 14 consisting of an upper cope section 16 and a lower drag section 18 (see FIGS. 4 and 5) is deposited in its assembled relationship upon the pallet, to a jacket transfer station JTS where a rectangular jacket with an open top and an open bottom is applied to the mold 14 on the pallet, after which the palletized and jacketed mold is conducted to a pouring station PS where it is filled with molten metal, suitable sprue and riser facilities 28, 29 being provided in the cope section 16 of the mold 14 in order to accommodate or receive the poured molten metal. From the pouring station PS, the poured, palletized and jacketed mold is returned to the jacket transfer station JTS for removal of the jacket, after which the poured palletized mold, minus its jacket, is conducted to a push off or mold discharge station MDS where the poured and now partially cooled and solidified mold is withdrawn or pushed from the pallet for the usual shake-out operations while the empty pallet is then returned to the mold-receiving station for reception thereon of a fresh mold, the entire operation being repetitious.

The illustrated conveyor system 10 is preferably, but not necessarily, predicated upon the planar step-by-step movement of the pallets 12 on a smooth sliding surface, each pallet, with certain exceptions, receiving either a longitudinal or a transverse movement from an adjacent preceding pallet in the series by a pushing operation wherein such pallet is displaced by the preceding pallet which then moves into the position formerly occupied by the displaced pallet. However, at certain changeover locations where a direction change in the path of movement of a pallet is to be effected, means are provided whereby a pallet void is created and into which a pallet is pushed by a preceding pallet, after which such pallet is then caused to change its direction of movement independently of a preceding motivating pallet, all in a manner and for purposes that will be made clear presently.

It is to be noted at this point that although in the interests of simplicity the pallets have been disclosed herein as being slidable on a smooth sliding surface, various other forms of pallet-supporting means may be employed if desired, such, for example, as a succession of rollers mounted on spindles which are held between parallel side members in a structural steel frame. Alternatively, wheeled pallets which travel on rails may be used, rolling in the longitudinal direction and being conveyed in the transverse direction by mechanical carrier means. Irrespective, however, of the particular type of mold-supporting pallets which may be employed, or of the manner in which such pallets are movably supported, the essential features of the present invention remain at all times substantially the same.

Still referring to FIG. 1 and, additionally, to FIG. 1*b*, the conveyor system 10 makes provision for four rows or paths of longitudinal indexing movement of the pallets 12, such paths being designated in the drawings by the legends LP1, LP2, LP3 and LP4. Forward longitudinal shifting or indexing movement of the pallets 12 in the path LP1 is effected under the control of a horizontally and longitudinally extending cylinder L1. Forward longitudinal shifting or indexing movement of the pallets in the path LP2 is effected under the control of a similar cylinder L2. Rearward longitudinal shifting or indexing movement of the pallets in the path LP3 is effected under the control of a cylinder L3 which, like the cylinders L1 and L2, extends horizontally and longitudinally. Rearward longitudinal shifting or indexing movement of the pallets 12 in the path LP4 is effected under the control of a horizontally and longitudinally extending cylinder L4. All of the cylinders L1, L2, L3 and L4 are of the normally retracted unit length stroke type, which is to say that the effective stroke of the various slidable piston rods which are associated with the cylinders is such that upon energization of each of these cylinders, the adjacent pallet will be displaced a distance equal to its length. It is to be noted, however, that although such cylinders are of the normally retracted type, for convenience of disclosure herein they are shown as being in their fully extended positions.

At the extreme forward end of the conveyor system 10, a normally retracted, horizontally and transversely extending piston rod-equipped cylinder T5 is provided for the purpose of displacing the adjacent two pallets 12 in the paths LP2 and LP1 simultaneously and pushing them bodily and transversely of the conveyor into the paths LP3 and LP4 respectively. The cylinder T5 is thus of the normally retracted two-unit length stroke type. At a medial longitudinal region of the conveyor system 10, a normally retracted, horizontally and transversely extending piston rod-equipped cylinder T6 is provided for the purpose of displacing an adjacent mold-carrying pallet 12 in the path LP3 transversely into the path LP1. At the extreme rear end of the conveyor system 10, a normally retracted, horizontally and transversely extending piston rod-equipped cylinder T7 is provided for the purpose of displacing an adjacent pallet 12 in the path LP4 transversely into the path LP3. The cylinders L1, L2, L3, L4, T5, T6 and T7 are all pallet-impelling units or mechanisms.

At a region approximately mid-way between the cylinders T6 and T7, a mold-ejecting, horizontally and transversely extending, cylinder T8 is provided for the purpose of pushing a mold 14 from its associated pallet 12 at the mold discharge station MDS, such stripping of the pallet taking place without disturbing the position of the pallet within the path LP4.

Figures 4, 5:
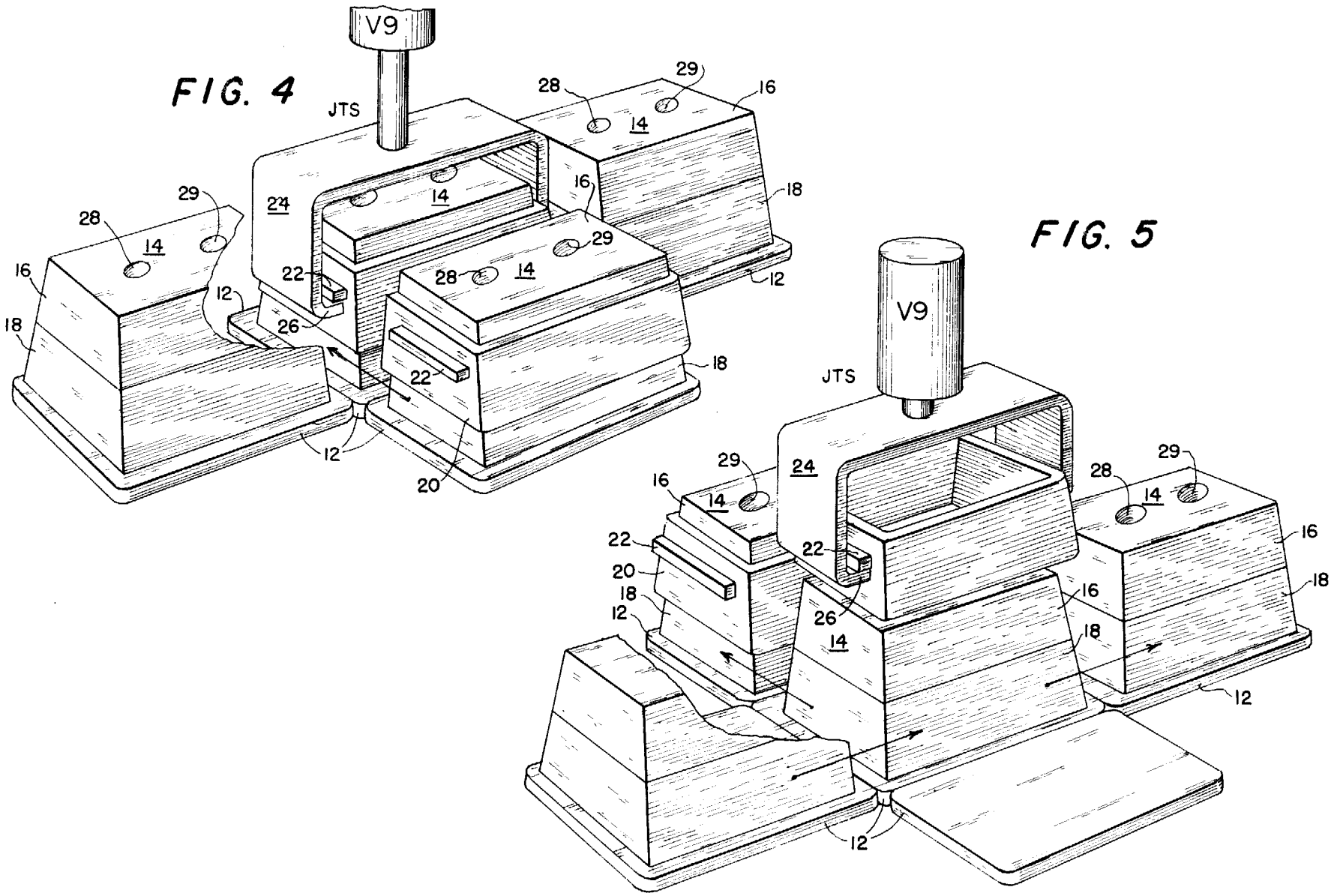
FIG. 4 is an enlarged fragmentary perspective view of a jacket shifting mechanism which is employed in connection with the present invention, such view showing the shifting mechanism in its jacket-raising position.
FIG. 5 is a perspective view similar to FIG. 4 but showing the jacket shifting mechanism in its jacket-lowering position.

Referring now to FIGS. 1, 4, and 5 of the drawings, the conveyor system 10 has, in addition to the cylinders just described a vertically acting, piston rod-equipped cylinder V9. Such cylinder forms a part of a mechanism which is located at the jacket transfer station JTS and is expressly for the purpose of lifting a jacket 20 from a palletized poured mold 14 which has been pushed transversely into such station by the cylinder T6 as shown in FIG. 4 (i.e., from the path LP3 and into the path LP1), then maintaining the jacket elevated as shown in FIG. 5 until such time as the cylinder L1 pushes a palletized unpoured mold longitudinally along the path LP1 into the station JTS, and then lowering the jacket onto such palletized unpoured mold.

As shown in FIGS. 4 and 5 of the drawings, each jacket 20 is in the form of a generally rectangular, upwardly tapered structure with its top and bottom open. The opposite ends of the jacket are provided with horizontally elongated pick-up lugs or flanges 22 which are designed for cooperation with a jacket lifter 24, the latter forming a part of the aforementioned jacket lifting mechanism, being of generally U-shape configuration, and having inturned flanges or lifting fingers 26 associated therewith. The lifter 24 is fixedly connected to the lower end of the piston rod of the cylinder V9. Said cylinder is suitably supported fixedly above the molds, the kind of support required being obvious and hence not shown. In order to prevent misalignment of the lifter fingers 26 with the pick-up lugs 22 on the jackets 20 as well as rotary displacement of the lifter as a whole, suitable means such as guide rods, key and keyways or the like (not shown) may be employed. It will be understood that, if desired, suitable weights (also not shown) may be applied to or otherwise associated with the various jackets 20 in a manner well known in the art.

Referring again to FIG. 1 of the drawings and considering the aforementioned longitudinal paths LP2, LP1, LP3 and LP4 of pallet movement, it is to be noted that in paths LP2 and LP1 all pallet-indexing movements are forward movements (movement toward the right-hand end of the conveyor system as shown in FIG. 1), while in paths LP3 and LP4 all pallet-indexing movements are rearward movements (movement in the direction of the left-hand end of the conveyor system as shown in FIG. 1). The cylinders T5, T6 and T7 establish three transverse paths of pallet movements, these being designated by the legends TP5, TP6 and TP7, respectively. The transverse path TP5 traverses all four of the longitudinal paths LP2, LP1, LP3 and LP4. The transverse path TP6 traverses the three longitudinal paths LP1, LP3 and LP2 and provides an intersection with the path LP1, the intersection taking place at the jacket transfer station JTS. The transverse path TP7 traverses the paths LP1 and LP4 and it also traverses the extended center line of the path LP3.

As previously indicated, the jacket transfer station JTS is disposed at the intersection between the longitudinal path LP1 and the transverse path TP6 and the jacket transfer mechanism which includes the jacket lifter 24 and its associated cylinder V9 is disposed and operates solely within the confines of such intersection.

The sequence chart of FIG. 3 of the drawings is not intended to show the relative time of each movement, only the sequence of those movements. Thus, one cycle of conveyor operation will, as indicated in the portion of the cycle labelled "A," include simultaneous extension then retraction of the rods of the four longitudinal cylinders L1, L2, L3 and L4; as indicated in the portion of the cycle labelled "B," will include extension of the rod of the jacket transferring cylinder V9; as indicated in the portion of the cycle labelled "C," will include simultaneous extension then retraction of the rods of the three transverse cylinders T5, T6 and T7, as well as of the rod of the cylinder T8; and, as indicated in the portion of the cycle labelled "D," will include retraction of the rod of the jacket transferring cylinder V9.

Since, as previously stated, the schematic disclosure of FIG. 1 shows the piston rods of the four longitudinally extending cylinders L1, L2, L3 and L4 as being in their extended positions, with the piston rods of the three transversely extending cylinders T5, T6 and T7 in their retracted positions, pallet voids will exist at the rear end of the path LP2 in the vicinity of the cylinder L2, at the rear end of the path LP1 in the vicinity of the cylinder L1, at the forward end of the path LP3 in the vicinity of the cylinder L3, and at the forward end of the path LP4 in the vicinity of the cylinder L4. It is obvious that for an effective shifting of any given longitudinal or transverse line of pallets 12 in any given path, there must necessarily exist at least one pallet void. Otherwise, the pallet path would go "solid" and no pallet movements could be effected.

The initial extension of the piston rod of the cylinder L1 which is indicated by the "A" portion of the conveyor cycle of FIG. 3 will cause the illustrated nineteen pallets 12 in path LP1 to be pushed bodily en masse forwardly (to the right as viewed in FIG. 1) so that the traverse region between the longitudinal path LP1 and the transverse path TP5 will be filled with a pallet. The initial extension of the piston rod of cylinder L2 will cause the eight pallets in the path LP2 to be pushed forwardly (to the right as viewed in FIG. 1) so that the transverse region between the longitudinal path LP2 and the transverse path TP5 will be filled with a pallet. Similarly, the initial extension of the piston rod of the cylinder L3 will cause the eight pallets in the path LP3 to be pushed rearwardly (to the left as viewed in FIG. 1) so that the traverse region between the longitudinal path LP3 and the transverse path TP6 will be filled with a pallet. Finally, initial extension of the piston rod of the cylinder L4 will cause the 19 pallets in path LP4 to be pushed rearwardly so that the traverse region between the longitudinal path LP4 and the transverse path TP7 will be filled with a pallet.

Disregarding for the present the entension and retraction of the piston rod of the cylinder V9 which controls the operation of the jacket shifting mechanism during the "B" and "D" portions of the conveyor cycle as comprehended by FIG. 3, and considering only the transverse pallet shifting operations which take place during the "C" portion of the cycle, extension of the piston rod of the cylinder T5 which, as previously stated, possesses a dual-unit length stroke will force the pallets 12 at the extreme forward ends of the paths LP2 and LP1 transversely along the path TP5 and thus move these two pallets into the pallet voids as the forward ends of the paths LP3 and LP4 which were created by retraction of the rods of the cylinders L3 and L4.

Extension of the piston rod of the cylinder T6 will force the rearmost pallet in the path LP3 transversely into the intersection which defines the jacket transfer station JTS. Extension of the piston rod of the cylinder T6 also will force the pallet which is disposed at such intersection and in the path LP1 out of the intersection and into the pallet void which was established by retraction of the rod of the cylinder L2.

Extension of the piston rod of the cylinder T7 will force the rearmost pallet in the path LP4 transversely along the path TP7 into longitudinal alignment with the rear region of the path LP3, extended while at the same time the pallet which previously occupied this position will be forced along the path TP7 into the void which was occasioned by retraction of the rod of the cylinder L1.

Still disregarding the jacket transfer operations which take place in the "B" and "D" portions of the conveyor cycle as comprehended by FIG. 3, and considering only pallet-shifting operations, it will be apparent that by reason of the aforementioned pallet movements which are occasioned by an initial simultaneous extension of the piston rods of the cylinders T5, T6 and T7, repeated performance of the conveyor cycle will cause each pallet in the system to follow an endless flow path as clearly shown in FIG. 1*b* of the drawings. The nature of the pallet load also is indicated by the symbols which are explained in the descriptive chart of FIG. 1*a*.

Referring now in detail to FIG. 1b in conjunction with FIGS. 1 and 1a, and starting at the mold-receiving station MS where a conventional molding machine such as is fragmentarily shown at 30 delivers the assembled sand molds successively to the conveyor system, each of the pallets 12 in that portion of the path LP1 which extends from said station MS to the jacket transfer station JTS including the intersection that is established at such station as previously described, supports a mold thereon as exemplified by the symbol "(2) PALLET WITH MOLD" of FIG. 1*a*. At this particular intersection, during each conveyor cycle, a mold-carrying pallet which has previously entered the intersection longitudinally under the influence of the cylinder L1, passes beneath a raised jacket 20 and the latter is immediately lowered by the cylinder V9 during the "B" portion of the cycle (see FIG. 3) so as to place the jacket upon the mold as shown in FIG. 4. After which, during the "C" portion of the cycle, the cylinder T6 causes the now jacketed and palletized mold to be pushed so that it leaves the intersection transversely and enters the pallet void at the rear end of the path LP2. During the "D" portion of the cycle, the cylinder V9 causes the jacket lifter 24 to become raised and, in so doing, this lifter removes a jacket 20 vertically from a preceding palletized poured mold in the row TP6 which moved transversely into the intersection during the "C" portion of the cycle from the path LP3 under the influence of the cylinder T6 in a manner that will be made clear presently.

Repetitious conveyor cycling effects intermittent shifting of the now jacketed and palletized molds forwardly in the row LP2 under the influence of the cylinder L2 as exemplified by the symbol "(3) MOLD WITH JACKET" (see FIG. 1*a*), and as each such mold enters the pouring station PS it is filled with molten metal. Thereafter, under the influence of the cylinder L2, the poured molds are advanced forwardly in the row LP2 as exemplified by the symbol "(4) POURED MOLD WITH JACKET," each outward stroke of the rod of the cylinder L1 causing such a poured mold to enter the void which exists at the forward end of the row and was established by retraction of the rod of the cylinder T5.

An important feature of the present invention resides in the provision of the dual-length stroke cylinder T5 which becomes effective during the "C" portion of each cycle (see FIG. 3) to propel the two foremost pallets 12 in the paths LP1 and LP2 transversely and shift them bodily and in unison into the paths LP3 and LP4. Thus, at the time the piston rod of cylinder T5 extends, the foremost poured jacketed mold 14 in the path LP2 is shifted transversely to the row LP3 where it comes under the influence of the cylinder L3 for subsequent rearward movement in the row LP3 during the "A" portion of each cycle as exemplified by the symbol "(4) POURED MOLD WITH JACKET." As shown in FIG. 1*b* of the drawings, such initial displacement of a poured jacketed mold from the path TP5 commences the establishment of a small rectilinear inner loop path which functions to bring the poured jacketed molds transversely into the intersection at the jacket transfer station JTS for withdrawal therefrom of their respective jackets and for return of the then unjacketed poured molds to the path TP5 forwardly along the path LP1.

Arrival of the individual palletized jacketed poured molds at the traverse region at the rear of the path LP3 is followed by a transverse movement of such mold under the influence of the cylinder T6 so as to push it into the intersection at the jacket transfer station JTS where, as previously described, raising of the jacket lifter 24 by the cylinder V9 during the "D" portion of each cycle (see FIG. 3), causes the jacket to be removed from such poured mold and held in readiness for subsequent deposition on a fresh unpoured mold emanating from the mold-receiving station MS and travelling forwardly and longitudinally along the path LP1 as previously described. The poured mold at the jacket transfer station JTS, now devoid of a jacket, becomes subject to the action of the cylinder L1 which advances all of the nineteen molds 12 in the path LP1 so that repetitious cycling or operation of the conveyor system 10 causes such molds to be pushed forwardy along the path LP1 as exemplified by the symbol "(5) POURED MOLD-JACKET OFF" (see FIG. 1*a*) and back to the path TP5 where the next extension of the rod of the cylinder T5 pushes the leading pallet in this path transversely through two pallet voids and into the path LP4 at the extreme forward end thereof. Thereafter, these unjacketed palletized poured molds come under the influence of the cylinder L4 and, upon repeated conveyor cycles, are carried rearwardly along the path LP4 as exemplified by the symbol "(5)" in FIG. 1*b* until they reach the push-off or mold discharge station MDS where they are pushed from their respective pallets 12 by the cylinder T8 and subsequently subjected to a shake-out operation.

The empty pallets leaving the mold discharge station MDS continue to travel rearwardly along the path LP4 under the influence of the cylinder L4 until they reach the traverse region between the paths LP4 and TP7, after which they are impelled transversely by the cylinder T7 during the "C" portion of each cycle, first into alignment with the path LP3 extended and finally into the pallet void which exists at the extreme rear end of the path LP1. From thence these empty pallets are impelled forwardly along the path LP1 until they reach the mold-receiving station MS where they are again supplied with a mold 14.

Figure 2:
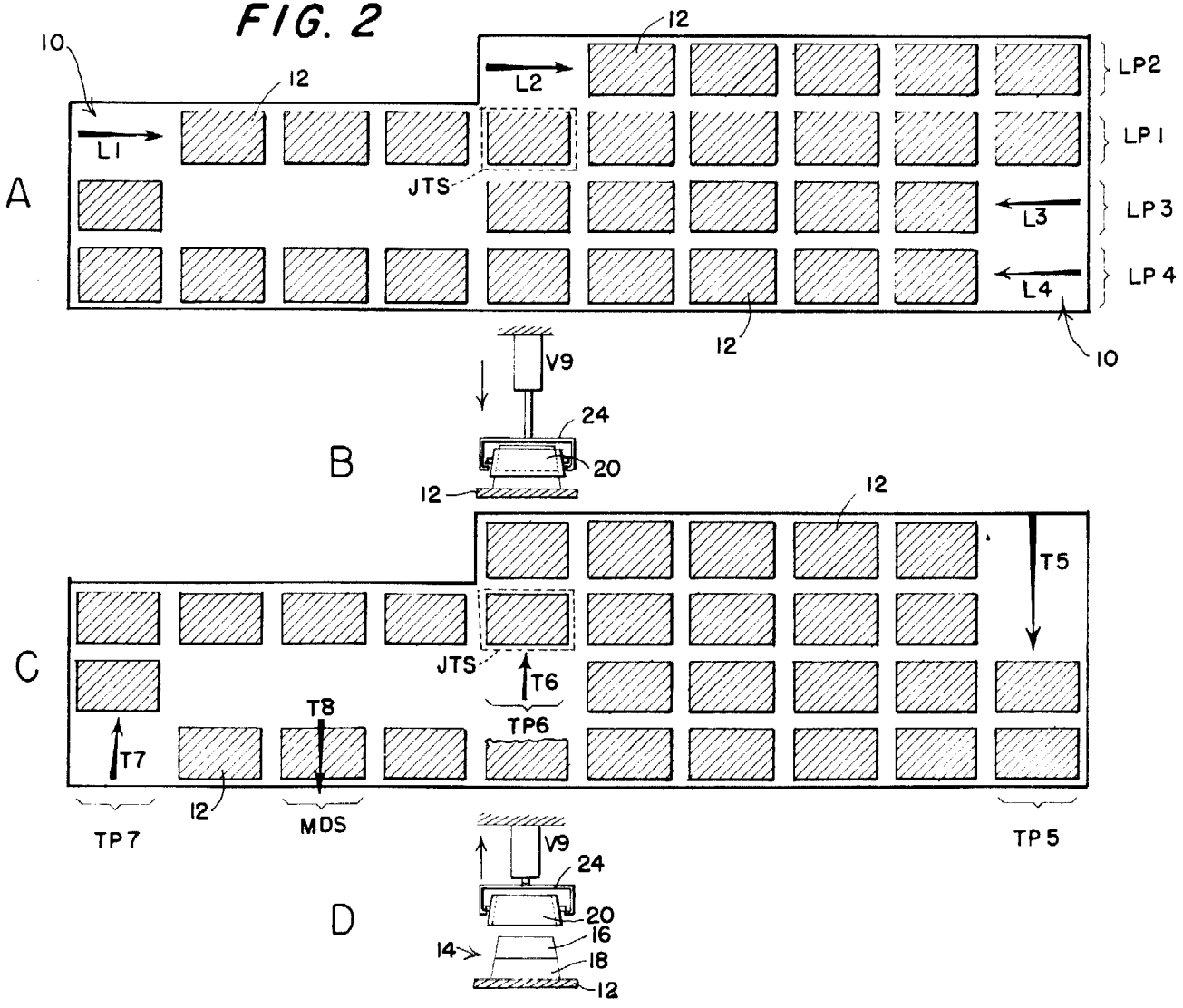
FIG. 2 is a somewhat simplified diagrammatic view of the conveyor system, illustrating the nature of the various pallet movements and also the nature of certain jacket transfer operations which take place during approximately each conveyor cycle.

In FIG. 2 of the drawings, the nature of the previously described pallet movements during the "A," "B," "C," and "D" portions of each conveyor cycle as comprehended by the timing chart of FIG. 3 is schematically disposed in a somewhat simplified form wherein the various pallet loads are omitted, only the pallets themselves and their paths of movement being shown. Also in FIG. 2, in the interests of simplicity, the number of pallets illustrated as compared with the number of pallets shown in FIG. 1 has been materially reduced.

In the "A" portion of the cycle, momentary extension of the piston rods of the cylinders L1 and L2 establishes the two pallet voids at the rear ends of the paths LP1 and LP2, while momentary extension of the piston rods of the cylinders L3 and L4 extablishes the two pallet voids at the forward ends of the paths LP3 and LP4. The pallet 12 which appears within the intersection which is established at the jacket transfer station JTS is one that has moved into the intersection forwardly along the path LP1 and it is to be noted that such pallet is in transverse register with the pallet void in the path LP2 so that after a jacket has been applied to the mold which is carried by such pallet, the latter is free to be shifted into such pallet void.

The application of a jacket 20 to the mold on the pallet at the jacket transfer station JTS is schematically portrayed in the "B" portion of the conveyor cycle in FIG. 2 wherein the piston rod of the cylinder V9 moves downwards to its extended position, thus setting the jacket 20 on the mold 14.

In the "C" portion of the cycle, momentary extension of the piston rod of the cylinder T5 establishes the two pallet voids at the forward ends of the paths LP2 and LP1; momentary extension of the piston rod of the cylinder T6 establishes the pallet void at the rear end of the path LP3; while momentary extension of the piston rod of the cylinder T7 establishes the pallet void at the rear end of the path LP4. Such momentary extension of the piston rods of the cylinders T5, T6 and T7 also fills the pallet voids which were created during the "A" portion of the conveyor cycle.

The lifting of the jacket 20 from a hot poured mold at the intersection which is established at the jacket transfer station JTS is disclosed in FIG. 2 in the "D" portion of the conveyor cycle, it being understood that the mold 14 which is shown at this portion of the cycle is one which recently had been pushed transversely by the cylinder T6 along the path TP6 and into such intersection. With the jacket 20 thus elevated, it remains in an out-of-the-way position so that the next succeeding stroke of the cylinder L1 may push the poured and palletized mold, minus a jacket, transversely from the intersection, while at the same time a fresh mold is pushed lonngitudinally into such intersection.

From the above description, it is apparent that the present invention is predicated largely upon two principal features of novelty, the first being the manner in which jacket transfer operations take place by reason of the vertical shifting movement of a jacket lifter such as that shown at 24 whose motions are entirely vertical and are confined within a single intersection which is defined by the crossing of a longitudinal path of pallet movement and a transverse path of pallet movement. The second feature of novelty resides in the manner in which the cylinder T5 having a dual-length stroke pushes a pair of adjacent pallets into a pair of pallet voids and also creates two pallet voids, the arrangement being such as to make possible the creation of a small inside auxiliary loop path by means of which poured and jacketed molds may be returned to the aforementioned jacket transfer station JTS for jacket withdrawal purposes. This dual-length stroke cylinder T5 represents a preferred manner of permitting pallets which have entered the inner closed auxiliary loop and traversed the same to leave the loop and proceed to the outer closed loop path without necessitating a bi-level arrangement where one pallet passes underneath another pallet. It thus makes possible a conveyor system where all pallet movements take place in a common plane so that at no time is any given pallet obliged to pass beneath another pallet.

It is to be understood that the pallets, molds and jackets which are mentioned in the foregoing description are not in themselves a part of the present invention, but rather they are articles which are commonly in use in the operation of a foundry. It is also to be borne in mind that the herein disclosed invention is largely schematic in its representation with much of the actual motivating machinery or other elements of the system being omitted in the interests of clarity. For example, whereas the various devices have been referred to herein simply as"cylinders," it will be understood that this term is intended to include fluid-operated cylinders, together with the usual fluid piping, reversing valve mechanisms, solenoids or other electrical and mechanical devices which are required to operate such cylinders at the required points in the operating cycle of the present conveyor system. Sequential control means of such devices is well known, conventional, and easily applied when the desired sequence is set forth as in this application, and being understood, is therefore omitted for clarity. Additionally, no specific times in each cycle have been specified for the operation of these cylinders nor has any correlation between the exact timing of the operation of such cylinders with respect to the timing of the jacket transfer cylinder V9 been expressed, only the sequence in which they occur. Still further, whereas the various pallet paths have been shown and described herein as being in contiguous relationship, such paths need not necessarily be contiguous, the only requisite being that the transversely extending cylinders T5, T6 and T7 be so designed as to fulfill their function of transferring the pallets or other mold-supporting carriages from one row to another in the manner required for successful operation of the system as a whole. Finally, it is not essential that fluid-actuated cylinders be employed inasmuch as it is within the purview of the invention to employ electrically operable pallet motivating devices if desired. Therefore, only insofar as the invention is particularly pointed out in the accompanying claims is the same to be limited.

Having thus described the invention what I claim as new and desire to secure by letters patent is:

1. A foundry mold conveyor system adapted for the intermittent indexing movement of mold supporting pallets and comprising:

a. means defining a plurality of elongated longitudinal pallet paths and a plurality of transverse pallet paths which are disposed in traversing relationship with respect to certain of said longitudinal paths at adjacent ends of the latter, said paths defining an outer generally rectangular closed loop and a reentrant inner rectangular cosed loop, all forming a continuous pallet circuit with the pallets progressing through both loops in the same circuit direction, b. means disposed along said circuit in advance of the reentrant loop and defining a mold-receiving station where fresh molds are delivered to empty pallets, and a pouring station where molten metal is poured into the palletized molds, c. means disposed along said continuous pallet circuit in arrears of the reentrant loop and defining a mold discharge station where mold-encased castings are discharged from the pallets, d. longitudinal and transverse pallet indexing means positioned at each path traverse and effective to index all of the pallets in the adjacent longitudinal and transverse paths respectively, e. one of said path traverses being disposed at the inner end of the reentrant loop and embodying an intersection between a longitudinal and a transverse path and defining a jacket transfer station where a mold jacket is applied to a palletized unpoured mold in advance of the pouring station and a mold jacket is removed from a palletized jacketed poured mold in arrears of said pouring station, and f. transfer means at said intersection for effecting such jacket transfer operations.

2. A foundry mold conveyor system as set forth in claim 1 and wherein all of said pallet paths lie in a common plane, the jacket transfer means comprises a vertically shiftable jacket lifter designed for lifting engagement with a downwardly facing shoulder on each jacket and movable bodily between a lowered position wherein it is disposed below the level of such shoulder on a mold-applied jacket approaching said intersection and a raised position wherein it elevates a jacket from a mold in said intersection to a level above that of the mold.

3. A foundry mold conveyor system as set forth in claim 2 and wherein the portion of the circuit in advance of the reentrant loop is provided with a laterally and outwardly disposed offset which establishes one of said longitudinal paths, said pouring station is disposed along said latter longitudinal path, the remainder of such portion of the circuit in advance of the reentrant loop is in longitudinal alignment with one leg of the reentrant loop and establishes a second longitudinal path, the other leg of the reentrant loop establishes a third longitudinal path, and the portion of the circuit in arrears of the reentrant loop establishes a fourth longitudinal path.

4. A foundry mold conveyor system as set forth in claim 3 and wherein a second of said path traverses is disposed at adjacent ends of said second and fourth longitudinal pallet paths, a third of said path traverses is disposed at adjacent ends of all four of said longitudinal pallet paths, the longitudinal pallet indexing means at each path traverse comprises a longitudinal cylinder, one for each longitudinal pallet path, effective a shift all of the pallets in such path one pallet length, the transverse pallet indexing means at the second path traverse comprises a transverse cylinder effective to shift pallets progressively one pallet width at a time from the fourth longitudinal pallet path to the second pallet path, the transverse pallet indexing means at the path traverse which defines the jacket transfer station comprises a transverse cylinder effective to shift pallets progressively, one pallet width at a time, from the third longitudinal pallet path into the intersection and consequently into the second longitudinal pallet path and thereafter into the first longitudinal pallet path, and the transverse pallet indexing means at the third path traverse comprises a transverse cylinder effective to shift pallets progressively, two pallet widths at a time, from the first longitudinal pallet path to the third longitudinal pallet path and also from the second longitudinal pallet path to the fourth longitudinal pallet path.

5. A foundry mold conveyor system designed for the intermittent indexing movement of mold supporting pallets and comprising:

a. means defining a relatively long first longitudinal path for the forward step-by-step indexing movement of pallets therealong, b. means disposed alongside said first path and defining a relatively short second contiguous outer marginal longitudinal path for the step-by-step forward indexing movement of pallets therealong, c. means disposed alongside said first path and defining a relatively short third contiguous inner longitudinal path for the step-by-step rearward indexing movement of pallets therealong, d. means disposed alongside said third inner path defining a relatively long fourth contiguous outer marginal longitudinal path for the step-by-step rearward indexing movement of pallets therealong, e. means disposed at the extreme forward end of said first, second, third and fourth paths and establishing a fifth and transverse pallet path for the sidewise indexing of pallets issuing from the terminal forward ends of said first and second paths, f. means disposed at the extreme rear ends of said second and third paths and establishing a sixth and transverse pallet path for the sidewise step-by-step indexing of pallets issuing from said third path, g. means disposed at the extreme rear ends of said first and fourth paths and establishing a seventh and transverse pallet path for the sidewise step-by-step indexing of pallets issuing from said fourth path, h. means disposed adjacent to the rear end of said first path and establishing a mold-receiving station where fresh molds are delivered to empty pallets, i. means disposed adjacent to the forward end of said second relatively short outer marginal path and establishing a pouring station where molten metal is poured into palletized molds, j. means disposed along said fourth path intermediate said sixth and seventh paths and establishing a mold discharge station where mold-encased castings are discharged from the pallets, k. said first and sixth paths defining an intersection establishing a jacket transfer station where mold jackets are removed from poured jacketed molds and are applied to fresh palletized molds, l. means disposed at said jacket transfer station for effecting the jacket transfer operations, m. respective longitudinal cylinders effective to index the pallets in each of the first, second, third, and fourth longitudinal paths one pallet length at a time, n. respective transverse cylinders effective to index the pallets in each of the sixth and seventh transverse rows one pallet width at a time, and o. a transverse cylinder effective to index the pallets in the fifth transverse row two pallet widths at a time.

6. A foundry mold conveyor system as set forth in claim 5 and wherein all of the pallets in the system lie in a common plane and maintain their directional orientation throughout all longitudinal and transverse movements thereof.

7. A foundry mold conveyor system as set forth in claim 6 and wherein said jacket transfer means comprises a vertically shiftable jacket lifter designed for lifting engagement with a downwardly facing shoulder on each jacket and movable bodily between a lowered position wherein it is disposed below the level of such shoulder on a mold-applied jacket approaching said intersection and a raised position wherein it elevates a jacket from a mold in said intersection to a level above that of the mold.

8. In an endless foundry mold conveyor system in which rectangular pallets are conducted along longitudinal and transverse paths by alternate longitudinal and transverse sidewise indexing movement of the pallets in step-by-step fashion, wherein longitudinal indexing advances the pallets into transverse paths and transverse indexing advances pallets into longitudinal paths, wherein fresh molds are delivered to pallets at a loading station, advanced to a pouring station where the molds are filled with metal by a pouring operation, then progress through a cooling stage to a mold discharge station where the mold-encased castings are pushed from the pallets for shake-out purposes, while empty pallets are returned to the loading station, and wherein jackets are removed from the molds subsequent to the pouring operation and are transferred to fresh molds prior to the pouring operation, the improvement which comprises:

a. means defining an intersection between a longitudinal path and a transverse path whereby upon indexing of pallets in said longitudinal path an unpoured mold enters the intersection along a longitudinal path, and a poured mold leaves the intersection along a longitudinal path, and upon indexing of pallets in said transverse path, a poured mold enters the intersection along a transverse path and an unpoured mold leaves the intersection along a transverse path, b. a vertically shiftable jacket lifter disposed at said intersection and designed for lifting engagement with a downwardly facing shoulder on a jacket, said jacket lifter being movable bodily between a lowered position wherein it is disposed below the level of such shoulder on a mold-applied jacket approaching said intersection in the longitudinal path, and a raised position wherein it elevates a jacket from a mold in the intersection and to a level above that of the mold, and c. means for moving said jacket lifter between its raised and lowered positions.

9. In an endless foundry mold conveyor system in which pallets are conveyed along longitudinal and transverse paths by alternate indexing movements, wherein longitudinal indexing advances the pallets into transverse paths and transverse indexing advances the pallets into longitudinal paths, wherein molds are loaded onto the pallets at a molding station, advanced into an area for pouring, then into an area for cooling, and are finally pushed off the pallets for shake-out before the pallets return to the molding station, wherein mold jackets are used for reinforcement of the molds against the pressure caused by the poured metal, are removed from the molds subsequent to pouring and transferred to the molds prior to pouring, and wherein means of actuation and control are used for causing longitudinal indexing movements, transverse indexing movements, and jacket lifting movements, the improvement which comprises:

a. an intersection of a transverse path and a longitudinal path such that upon indexing of the pallets along said transverse path, a poured mold enters the intersection and an unpoured mold leaves the intersection both transversely, and upon indexing of said longitudinal path, an unpoured mold enters the intersection and a poured mold leaves the intersection, both longitudinally, b. transfer means at said intersection for engaging a jacket on a mold and lifting it above the mold by an upward movement after the transverse index and for disengaging and setting said jacket on a mold by a downward movement after the longitudinal index, and c. jacket means for being engaged and lifted by said transfer means.

10. The improvement of claim 9 in which the indexing movement of a path receiving molds with jackets is twice the indexing movement of one of the paths parallel to it, thereby allowing return of the pallets in an endless flow without passing under other pallets in the system.

11. The improvement of claim 9 wherein a transverse path receiving molds with jackets advances its pallets a distance equal to twice that to which the intersecting transverse path advances its molds, thereby allowing return of the pallets in an endless flow without passing under other pallets in the system.

12. The improvement of claim 9 wherein a transverse path advances a poured mold a distance of two pallets, thereby allowing return of the pallets in an endless flow without passing under other pallets in the system.

13. The improvement of claim 9 wherein a transverse path advances both a poured mold with a jacket and a poured mold without a jacket a distance of two pallets thereby allowing return of the pallets in an endless flow without passing under other pallets in the system.

14. In a foundry mold conveyor system, that method of transferring mold jackets from poured molds to empty fresh molds, which comprises the steps of alternately causing empty unjacketed molds to enter a jacket transfer station in a horizontal longitudinal direction and jacketed poured molds to enter such station in a horizontal transverse direction, each with a period of dwell at such station, said station defining an intersection between a longitudinal pallet path and a transverse pallet path, removing a jacket from each poured jacketed mold during its period of dwell within the intersection, applying such removed jacket to each unjacketed mold during its period of dwell within the intersection, alternately causing the jacket-applied empty molds to leave the intersection in a transverse direction and the poured jacket-relieved molds to leave the intersection in a longitudinal direction, conducting the jacket-applied empty molds from the intersection to a pouring station for subsequent return to the intersection as jacketed poured molds, and conducting the poured jacket-relieved molds from the intersection to a shake-out station.

15. In a foundry mold conveyor system, the method set forth in claim 14 and wherein lifting flanges are provided on the jackets; the step of removing a jacket from each poured jacketed mold during its period of dwell within the intersection comprises maintaining a vertically-shiftable jacket lifter having pick-up fingers thereon within the intersection at a level wherein said fingers underlie the lifting flanges on each poured jacketed mold as it enters the intersection and then, during the dwell period of such mold, raising the jacket lifter vertically so as to support and raise the jacket above the level of the next succeeding empty unjacketed mold entering the intersection; and the step of applying such removed jacket to such succeeding empty unjacketed mold comprises lowering said jacket lifter with the jacket which is supported thereon during the dwell period of such succeeding mold until the jacket is effectively deposited on such succeeding mold.

16. An endless foundry mold conveyor system for conveying on pallets foundry molds with associated jackets through a plurality of stations including in order a station at which the molds are made and placed on pallets, a station at which jackets are transferred from poured molds to unpoured molds, a station at which molten metal is poured into said molds, and a station for pushing off the poured molds from their respective pallets for shakeout, the system comprising, a plurality of conveyor sections for supporting pallets to move along such sections, said sections forming a continuous, endless route of connected paths alternately longitudinal and transverse, a plurality of pallets disposed on such paths, one pallet touching the next, but initially one pallet position on each longitudinal path being unoccupied by a pallet, means for advancing the first pallet on each path a distance of one pallet, the remaining pallets in that path being closed up and advanced also by movement of the first pallet, and means for initially actuating the advancing means of the longitudinal paths, and thereafter actuating alternately the advancing means of the transverse paths and the advancing means of the longitudinal paths, whereby the pallets are advanced intermittently along said paths through said plurality of stations in said endless route, wherein the improvement comprises:

a. an arrangement of paths which includes an intersection of a transverse path and a longitudinal path such that, when pallets are advanced along the transverse paths, a poured mold with a jacket enters the intersection, and when pallets are advanced along the longitudinal paths, an unpoured mold without a jacket enters the intersection, b. transfer means at said intersection for vertically moving a jacket, whereby after a poured mold with a jacket enters the intersection, an upward movement of said means engages the jacket and elevates it above the mold, and whereby after an unpoured mold without a jacket enters the intersection, a downward movement of said means lowers the jacket onto the mold and disengages the means from the jacket, and c. means on each jacket for being engaged by an upward movement of the transfer means and for being disengaged by the downward movement of the transfer means when the jacket rests upon a mold or pallet.

17. The improvement in an endless foundry mold conveyor system according to claim 16 and in which the continuous endless route also includes a minor closed loop of alternately longitudinal and transverse paths, and said intersection includes one transverse path of said minor loop.

18. The improvement in an endless foundry mold conveyor system according to claim 17 and in which one transverse path of said minor loop has one end connected to first and second adjacent longitudinal paths and has its other end connected to third and fourth adjacent longitudinal paths, and the advancing means of the aforesaid one transverse path of the minor loop advances pallets a double pallet distance, whereby at each transverse movement pallets are advanced out of said first and second adjacent longitudinal paths and are advanced into said third and fourth adjacent longitudinal paths.

19. The improvement in an endless foundry mold conveyor system according to claim 18 and in which said first and third longitudinal paths are paths of said minor closed loop, and said second longitudinal path is the intersective longitudinal path of said intersection.

* * * * *